US006971138B2

(12) United States Patent
Berti

(10) Patent No.: US 6,971,138 B2
(45) Date of Patent: Dec. 6, 2005

(54) DUSTPAN AND BROOM KIT

(75) Inventor: Enzo Berti, Dolo (IT)

(73) Assignee: The Libman Company, Arcola, IL (US)

( * ) Notice: Subject to any disclaimer, the term of this patent is extended or adjusted under 35 U.S.C. 154(b) by 0 days.

(21) Appl. No.: 10/667,954

(22) Filed: Sep. 22, 2003

(65) Prior Publication Data

US 2005/0060831 A1 Mar. 24, 2005

(51) Int. Cl.[7] ..... A47L 13/52

(52) U.S. Cl. ..... 15/257.2; 15/257.9; 15/159.1; D32/74

(58) Field of Search ..... 15/159.1, 171, 15/257.1–257.9, 175; D32/74; D8/10; D30/162

(56) References Cited

U.S. PATENT DOCUMENTS

| | | | | |
|---|---|---|---|---|
| D345,238 | S | 3/1994 | Berti | |
| D347,915 | S | 6/1994 | Berti | |
| 5,839,145 | A * | 11/1998 | Petner | 15/105 |
| D468,106 | S * | 1/2003 | Robertson | D4/116 |
| D475,828 | S | 6/2003 | Libman et al. | |
| D481,504 | S | 10/2003 | Libman et al. | |

* cited by examiner

*Primary Examiner*—John Kim
*Assistant Examiner*—Shay L. Balsis
(74) *Attorney, Agent, or Firm*—Banner & Witcoff, Ltd.

(57) ABSTRACT

A combination dustpan and broom form a kit wherein the dustpan includes a handle adapted to receive and grip the handle of the broom and further wherein the dustpan is formed in an asymmetric shape including a straight sidewall that facilitates directional movement of dust or trash collected in the dustpan.

9 Claims, 3 Drawing Sheets

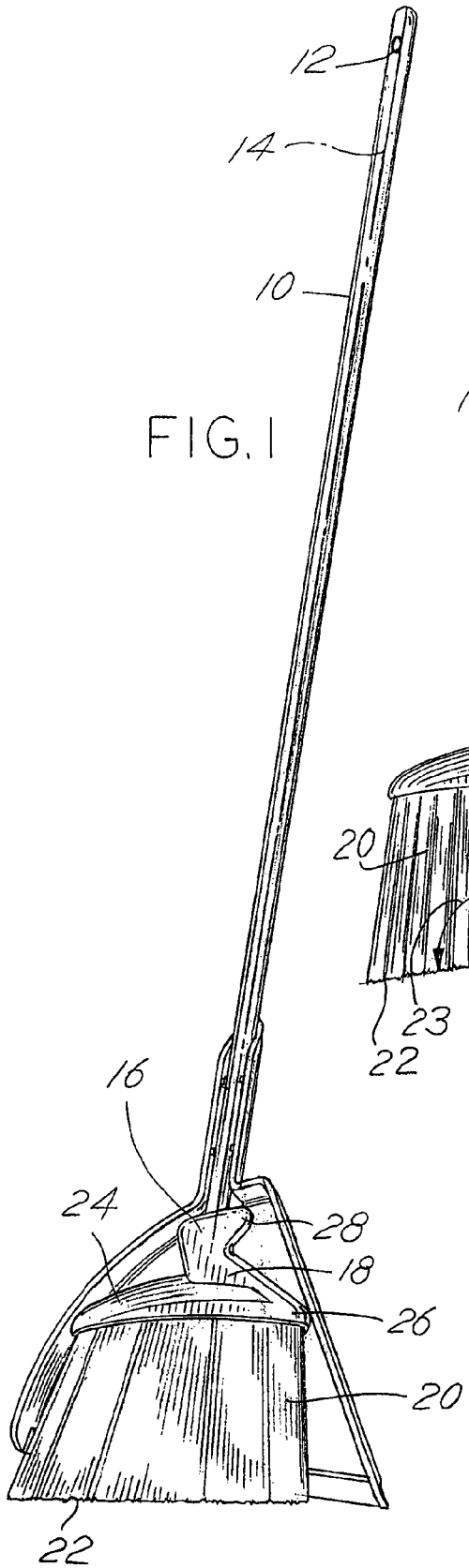
FIG. 1
FIG. 2
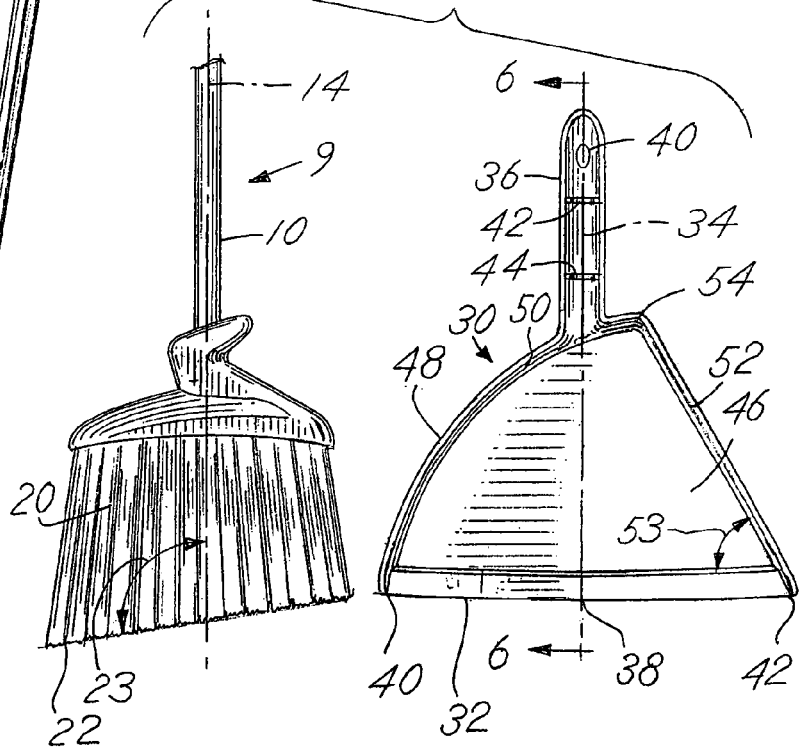

DUSTPAN AND BROOM KIT

BACKGROUND OF THE INVENTION

In a principal aspect, the present invention relates to a combination dustpan and broom kit wherein the dustpan has an asymmetric configuration and is constructed to snap onto the handle of a broom which has asymmetric features.

A combination dust brush or broom and dustpan combination kit has heretofore been utilized. Typically, a dustpan may be formed by a plastic molding process with a handle along the top side of the dustpan opposite a leading edge of the dustpan provided for placement against a floor. Dust and trash may then be swept into the dustpan which is held by its handle. The handle of such a dustpan construction may include a gripping or detent mechanism designed to frictionally engage and hold the handle of a brush or a broom. Thus, when storing the dustpan and broom or brush, it is possible to store them together with the dustpan snap-fitted onto the broom handle and with the bristles of the broom or brush retained generally within the region of the tray of the dustpan.

Generally, such dustpans are made by a plastic injection molding process and thus the dustpan itself is a plastic material. Typically, the broom or brush is made from molded plastic in combination with bristles from various sources. Also broom handles may be metal, wooden or plastic. Such combinations are useful and especially popular with homeowners inasmuch as the dustpan and the broom may be stored together. That is, the component dustpan and broom assembly or kit, when stored together, become more useful inasmuch as the dustpan may be used optionally as necessary and, of course, the broom and dustpan are kept together when not in use.

Despite the popularity of such combinations, there has remained a need for improved features to be associated with such constructions. The ability to use the component parts in restricted spaces is desirable. When the dustpan is being emptied, or when the trash is being removed therefrom, it is desirable to insure that the contents of the dustpan will flow appropriately in a manner desired by the user. As a consequence, there has remained a need for improved functional designs for such items.

SUMMARY OF THE INVENTION

Briefly, the present invention comprises a dustpan and broom retained together as a kit, though the individual components are separable for separate use. The dustpan includes a tray with a leading edge and a retention rib opposite the leading edge. The tray and retention rib are formed asymmetrically having an arcuate section joined to a straight line section with each of the sections connected respectively to the opposite ends of the straight leading edge of the tray. A handle is formed extending from the retention rib. The handle extends generally at a right angle to the leading edge and is positioned approximately midway between the opposite ends of the leading edge. The handle includes a broom handle cavity for receiving and retaining a broom handle. The dustpan is designed to be useful for collecting dust in generally inaccessible corners and to provide to function as a funnel when emptying the filled dustpan.

A broom includes a handle, a bristle support head and bristles inserted in and projecting from the bristle support head. The bristle head is configured to fit within the pan with the handle engaging the handle retention mechanism of the dustpan. The dustpan thus has the capability of being attached to the broom and thus, in combination with the broom, form a kit.

Thus, it is an object of the invention to provide an improved dustpan and broom kit.

It is a further object of the invention to provide a dustpan having an asymmetric configuration which incorporates aesthetic characteristics as well as functional characteristics.

Another object of the invention is to provide a dustpan which is especially useful when attempting to collect dust or trash in generally inaccessible corners and other restricted access places and to provide a feature which enables controlled emptying of the dustpan by directing the trash or dust therefrom.

Another object of the invention is to provide an easily used combination dustpan and broom kit having utilitarian functions, yet which is aesthetically attractive and further which can be easily stored, particularly in combination when not in use.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a plan view of the combination dustpan and broom kit assembled;

FIG. 2 is a plan view of the broom and dustpan of the invention wherein the component parts forming the kit have been separated and are arranged in side-by-side array;

DESCRIPTION OF THE PREFERRED EMBODIMENT

Figure 3:
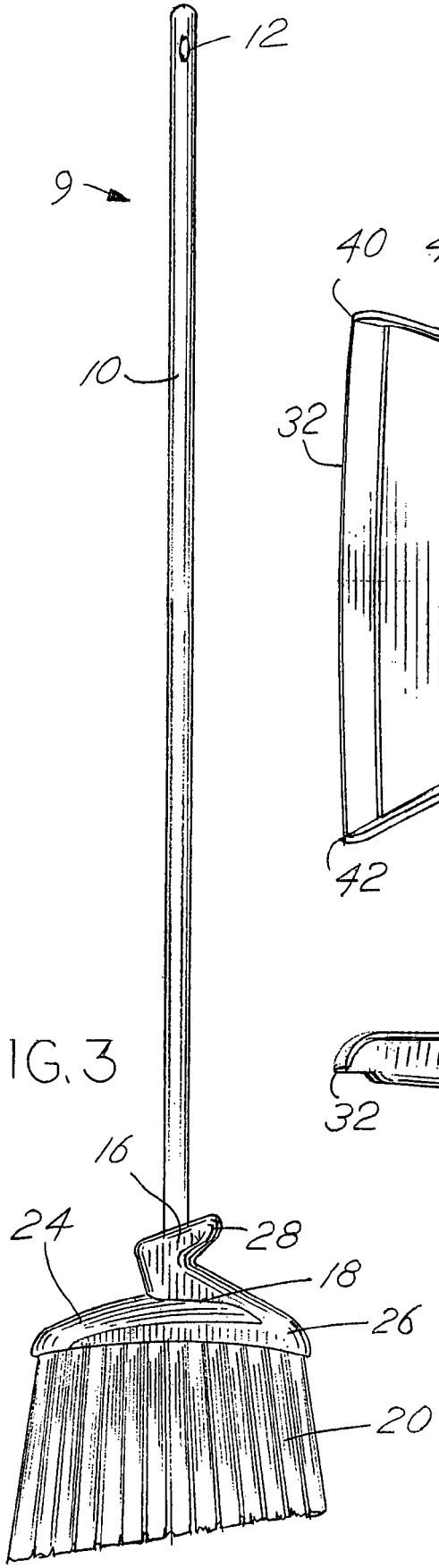
FIG. 3 is an isometric view of the broom of the kit.
Figure 4:
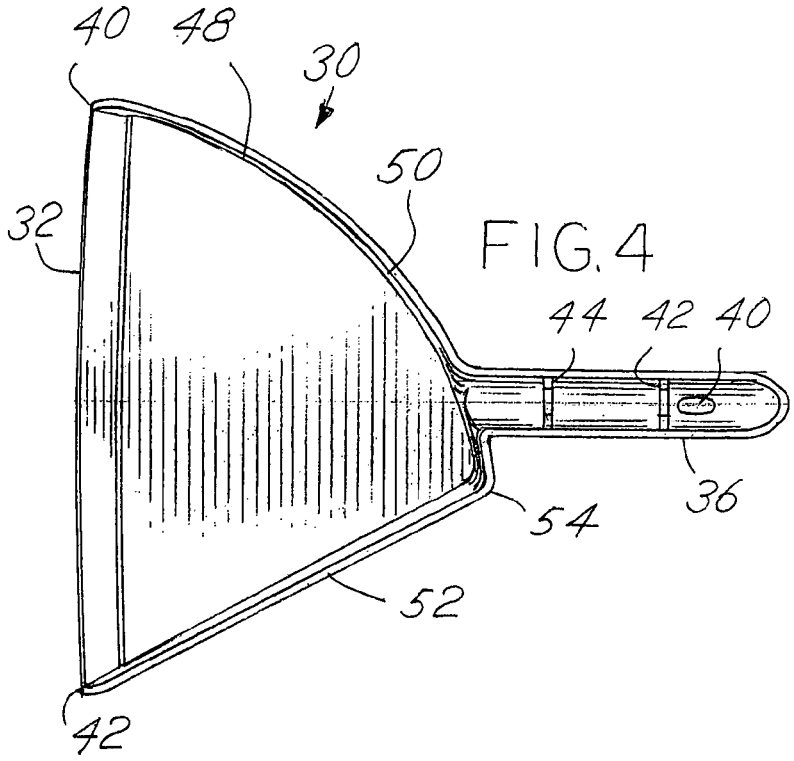
FIG. 4 is a plan view of the dustpan component of the kit.
Figure 5:
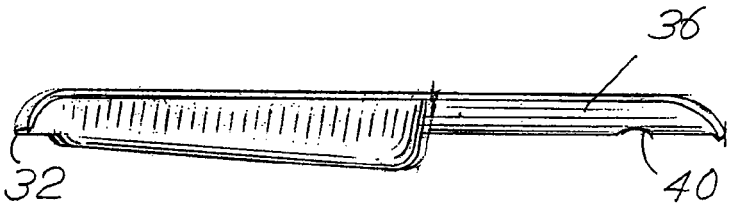
FIG. 5 is a side view of the dustpan of FIG. 4.
Figure 6:
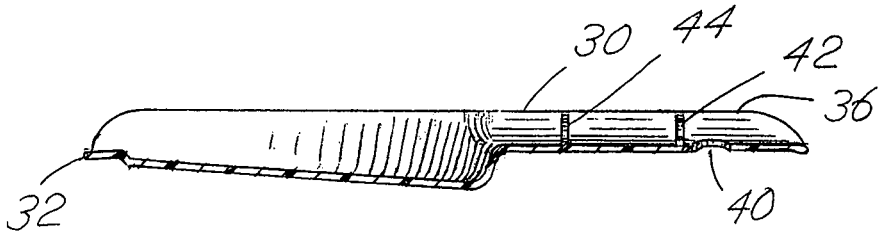
FIG. 6 is a sectional view of the dustpan of FIG. 4 taken along the line 6—6.
Figure 7:
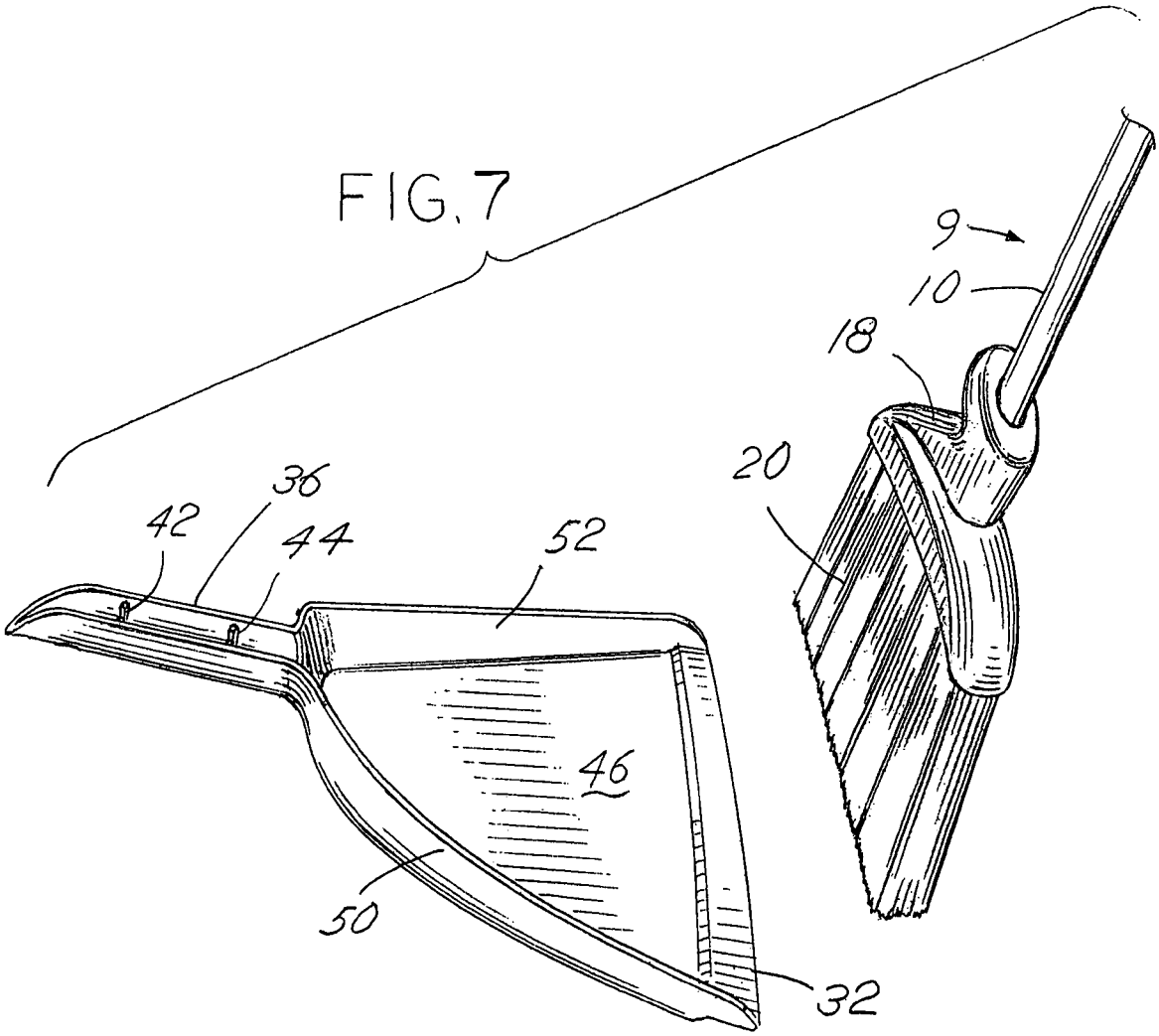
FIG. 7 is an isometric view of the combination dustpan and broom illustrating the manner of use thereof.

Referring to the figures, the kit of the invention is comprised of a broom and dustpan. A broom 9 includes a handle 10 in the form of a rod. The handle 10 in the form of a rod may be a hollow metal handle, a wooden handle, a molded or extruded plastic rod. Typically, the handle 10 will include a hook, slot or passage 12 at its outer distal end which will enable the handle 10 to be hung from a peg or a hook for storage.

The broom handle 10 defines a longitudinal axis 14 and is engaged or fitted into a bore 16 in a bristle support head 18. The bristle support head 18 is typically manufactured from a molded plastic such as polypropylene. Bristles 20 are fastened into the head 18. Typically, the bristles 20 will form a sweep plane 22 which is a generally straight line. Plane 22 is inclined at an obtuse angle 23 with respect to the axis 14 of the handle 10.

The bristle support head 18 is configured in a manner which has a forward side or end 24 and a rear side or end 26. The ends 24 and 26 are reduced in height relative to center section 28 of the bristle support head 18. This enables and facilitates movement of the broom beneath the ledge of a step, for example, or in another difficult or inaccessible places to reach.

The broom cooperates with a dustpan 30. The dustpan 30 includes a generally straight line leading edge 32 which forms a right angle with axis 34 of a handle 36 of the dustpan 30. The axis 34 also bisects the leading edge 32 of the dustpan 30 intersecting the midpoint 38 thereof between opposite ends 40 and 42. The dustpan handle 36 is in the form of a semi-cylindrical member with a slot or opening 40 therethrough so that the dustpan may be supported on a hook by way of example. Detent gripping members 42 and 44 are molded on the inside surface of the semi-cylindrical handle 36. In this manner, the broom handle 10 may be fitted into the compatibly sized and configured dustpan handle 36 and retained and engaged by means of the retention members 42 and 44.

The dustpan 30 further includes a tray 46 which is generally a flat planar tray bounded by the straight line leading edge 32 and further bounded opposite the leading edge 32 by a retention rib or retention wall 48. The retention wall 48 is comprised of a first arcuate section 50 which, in the preferred embodiment, is the arc of a circle. The wall 48 further includes a generally straight line section 52, which forms an angle 53 in the range of 50–75° with the leading edge 32. The arcuate wall 50 joins or connects to the substantially straight section 52 at a junction 54 which is located to one side of the handle 36 thereby providing an asymmetric configuration for the tray 46.

In use, the asymmetric configuration of the dustpan 30 facilitates its ability to direct and collect dust and trash into the tray 46. Thus, the sidewall 52, which is a straight wall section, provides or acts as a funnel so that trash may be easily directed into a receptacle or container after it is collected in the tray 46. Additionally, the configuration of the straight section 52 in combination with the leading edge 32 defines a shape for the tray 46 which enables positioning of the end 42 in difficult to reach places, such as corners, thereby facilitating the transfer of trash or dust into the tray. The arcuate section 50 facilitates movement of dust or trash along its periphery by action of the broom bristles toward a straight section 52. Again this augments the funneling of trash when emptying tray 46.

The asymmetric configuration of the tray provides functional benefits as well as providing a unique and aesthetic appearance. It is possible to vary the configuration and shape of the tray, as well as the broom as described herein. For example, the angles of the various sections and the configuration of the arcuate wall 50 may be varied significantly. The shape and configuration of the handle 36 of the dustpan may be altered or configured in a different manner. Thus, while there has been set forth the preferred embodiment of the invention, it is to be understood that the invention is limited only by the following claims and equivalents thereof.

What is claimed:

1. A dustpan and broom kit comprising, in combination:

a dustpan including a tray with a leading edge and a retention rib opposite the leading edge, a handle connected to the retention rib, said handle projecting in a straight line from the rib and forming a generally right angle with the leading edge, said handle including a broom handle cavity and retention mechanism for receiving and retaining a broom handle, said tray having a planar, asymmetric shape bounded by the retention rib, said rib defining a continuous arcuate section extending from one side of the leading edge to said handle and a substantially straight section extending from the other side of the leading edge; and a broom with a broom handle having a longitudinal axis, a bristle support head attached to one end of the broom handle, said bristle support head having a top side attached to the handle and a bottom side with bristles projecting from the bottom side, said bristles defining a sweeping plane, said broom handle axis and said sweeping plane forming an obtuse angle, said broom handle engageable with the broom handle cavity of the dustpan to hold the pan and broom together as a kit wherein the broom is releasable from the dustpan.

2. The kit of claim 1 wherein the straight section of the retention rib forms an angle in the range of about 50–75° with the leading edge.

3. The kit of claim 1 wherein the arcuate section of the retention rib is a circular arc.

4. The kit of claim 1 wherein the arcuate section of the retention rib engages the straight section at an intersection adjacent a side of the dustpan handle.

5. The kit of claim 1 wherein the bristle support head is asymmetric with a first longer bristle end and a second shorter bristle end.

6. The kit of claim 5 wherein the bristles at the first longer bristle end of the bristle support head are longer than the bristles at the second shorter bristle end.

7. The kit of claim 1 wherein the dustpan handle projects from an end of the arcuate section opposite the leading edge.

8. The kit of claim 1 wherein the dustpan handle projects from the arcuate section at a position intermediate of the ends of the arcuate section.

9. The kit of claim 1 wherein the bristles are of varying lengths.

* * * * *